US005397858A

United States Patent [19]

Delalle

[11] Patent Number: 5,397,858

[45] Date of Patent: Mar. 14, 1995

[54] ELECTRICAL CONNECTOR

[75] Inventor: Jacques Delalle, Triel Sur Seine, France

[73] Assignee: Raychem S.A., France

[21] Appl. No.: 94,184

[22] PCT Filed: Feb. 4, 1992

[86] PCT No.: PCT/GB92/00211

§ 371 Date: Aug. 2, 1993

§ 102(e) Date: Aug. 2, 1993

[87] PCT Pub. No.: WO92/14981

PCT Pub. Date: Sep. 3, 1992

[30] Foreign Application Priority Data

| | | | |
|---|---|---|---|
| Feb. 7, 1991 | [GB] | United Kingdom | 9102659 |
| Sep. 3, 1991 | [GB] | United Kingdom | 9118841 |
| Dec. 10, 1991 | [GB] | United Kingdom | 9126204 |

[51] Int. Cl.[6] ..... H01R 4/22; H01R 4/02; H01R 43/02

[52] U.S. Cl. ..... 174/87; 29/872; 174/84 R; 174/DIG. 8

[58] Field of Search ..... 174/87, 84 C, 84 R, 174/DIG. 8; 29/868, 872

[56] References Cited

U.S. PATENT DOCUMENTS

| | | | |
|---|---|---|---|
| 1,297,614 | 3/1919 | Viersen | 174/87 |
| 3,083,260 | 3/1963 | Bird | 174/87 |
| 3,243,211 | 3/1966 | Wetmore | 287/78 |
| 3,525,799 | 8/1970 | Ellis | 174/84 R |
| 3,708,611 | 1/1973 | Dinger | 174/84 C |
| 4,112,251 | 9/1987 | Scott | 174/87 |
| 4,531,016 | 7/1985 | Duve | 174/87 |
| 4,595,724 | 6/1986 | Koblitz | 175/84 R |
| 4,883,921 | 11/1989 | Legerius et al. | 174/87 |
| 5,023,402 | 6/1991 | King, Jr. et al. | 174/87 |
| 5,086,987 | 2/1992 | Delalle et al. | 228/56.3 |
| 5,221,815 | 6/1993 | Bostock et al. | 174/84 R |
| 5,260,515 | 11/1993 | Braun, Jr. | 174/87 |
| 5,271,975 | 12/1993 | Solano | 174/DIG. 8 |

FOREIGN PATENT DOCUMENTS

| | | |
|---|---|---|
| 0432662 | 6/1991 | European Pat. Off. . |
| 87/05447 | 9/1987 | WIPO . |
| 88/09068 | 11/1988 | WIPO . |
| 92/00616 | 1/1992 | WIPO . |

*Primary Examiner*—Morris H. Nimmo
*Attorney, Agent, or Firm*—Sheri M. Novack; Herbert G. Burkard

[57] ABSTRACT

A device 1 for forming an electrical connection between a plurality of electrical conductors comprises an electrically insulating sleeve (3), a metallic connecting element (4) located within the sleeve and a quantity of solder (8) for forming a permanent electrical connection between the conductors. The connecting element (4) has an external surface that is uneven so that a significant proportion of any radiation that is radially inwardly directed onto the external surface of the element will be reflected at least twice by the external surface of the element.

This uneveness enables the response of the device to heating by infrared radiation to be significantly improved. The connecting element may be formed for example by coiling a wire having a polygonal, e.g. square, cross-section into a frusto-conical helix.

11 Claims, 3 Drawing Sheets

Fig. 1.
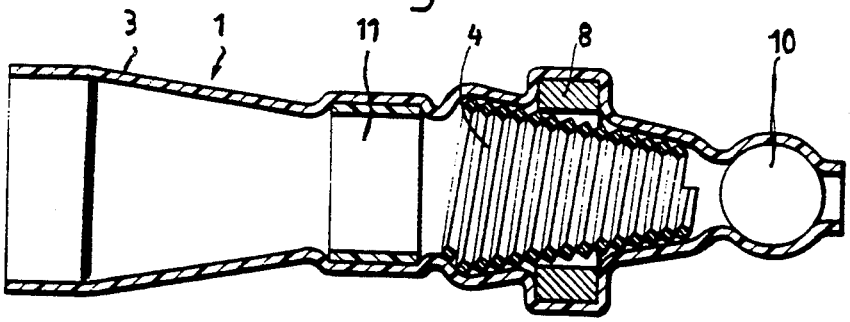
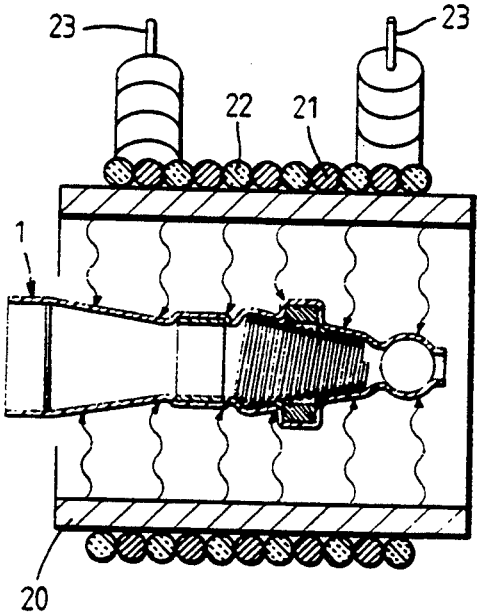
Fig. 2.
Fig. 3.
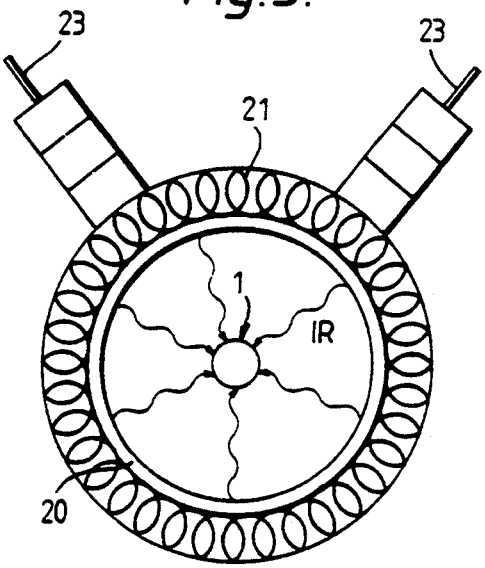

ELECTRICAL CONNECTOR

This invention relates to electrical connectors, and especially to connectors for forming solder joints between conductors in such articles as automotive harnesses and the like.

Electrical harnesses, for example as manufactured in the automotive industry, are often quite complex. In some instances they are manufactured by forming two or more sub-assemblies of wires, terminals, connectors and any other components, and then forming electrical connection(s) between the sub-assemblies. In such a case the assembly of the harness may be controlled by computer permitting, with the aid of a monitor, the assembly operator to see schematically the lay up and to check correct build-up of the assembly at each stage of the harness manufacture. In order to enable this control process to operate the ends of the conductors of the sub-assemblies are connected, e.g. by means of spring contacts, and an electrical current or signal is passed through the assembly in order to obtain verification that the harness is correct. It is only after such verification is obtained that the clips are removed and a permanent electrical connection is formed.

A device for forming an electrical connection in such a harness described in our copending application No. PCT/GB91/01016 (FIGS. 1 to 6) the disclosure of which is incorporated herein by reference. That device comprises a metallic connecting element in the form of tapering helical coil of wire located in a dimensionally heat-recoverable sleeve, and a quantity of solder. Such a device enables a temporary electrical connection to be formed by screwing the device onto the wires and then, after the harness has been tested, the device can be heated to form a permanent electrical connection.

According to one aspect, the present invention provides a device for forming an electrical connection between a plurality of electrical conductors, which comprises an electrically insulating sleeve, a metallic connecting element located within the sleeve and a quantity of solder for forming a permanent electrical connection between the conductors, the connecting element having an external surface that is sufficiently uneven that a significant porportion of any radiation that is radially inwardly directed onto the external surface of the element will be reflected at least twice by the external surface of the element.

The device according to the present invention has the advantage that it enables the connecting element, and hence the solder if they are in thermal contact, to be more responsive to infrared radiation used for heating the device than the device described in the above international application since a greater proportion of the radiation is absorbed by the element due to the increased number of reflections.

The device preferably has a connecting element with a tapering internal surface having a screw thread so that a temporary electrical connection can be formed by twisting the connecting element about the conductors.

Thus, according to another aspect, the invention provides a method of forming an electrical connection between a plurality of electrical conductors, which comprises:

(i) positioning about the conductors a device which comprises an electrically insulating sleeve, a metallic connecting element located within the sleeve and a quantity of solder, the connecting element having a tapering internal surface with a screw thread, and having an uneven external surface;

(ii) twisting the device about the conductors to hold them in the connecting element; and (iii) applying infrared radiation radially inwardly to heat the device and so cause the solder to melt and form a permanent connection between the conductors;

wherein a significant proportion of the radiation is reflected at least twice by the external surface of the connecting element.

The connecting element may generally have any form although it is preferred for it to be formed by coiling a piece of wire into a tapering coil so that the windings form the screw thread. Preferably the internal surface of the connecting element is at least partly conical, for example it may be conical or frusto-conical. If the connecting element is formed from a wire, it can grip the bundle of conductors introduced therein due to the resilience of the wire and the fact that it will be enlarged radially to some extent by the introduction of the bundle. However, in one advantageous form of device it has been radially expanded from its relaxed state during manufacture of the device and to be retained in its expanded state so that it will radially contract, or attempt radially to contract, when the permanent connection is formed. Thus, for example, the spring may be held out against its resilient recovery forces by the sleeve or by the solder, so that softening of the sleeve or melting of the solder will allow the spring to recover. For example, a boss may be formed on the internal surface of the sleeve or on the internal surface of the solder which will disappear when the device is heated. The degree of expansion need not be great, for example it may be not more than 5% or even not more than 2%, since it may be desirable that the coil remains in contact with the solder element when the device is heated.

It is advantageous for the wire to be formed with a polygonal, and especially a square, cross-section. The wire may be formed from any appropriate metal or metal alloy, but preferably is formed from copper, and especially from copper having substantially the same purity as that conventionally employed for electrical conductors.

Other configurations of connecting element may, however, be employed. For example it may be formed from a solid block of metal that has been tapped with a screw thread on its internal surface, and on its external surface has been tapped with a further screw thread or has milled grooves.

The degree of unevenness of the external surface is preferably such that at a major part (at least 50%) of any radially inwardly directed radiation will be reflected at least twice, more preferably such that at least 70% and especially at least 90% of any radiation is reflected at least twice by the external surface.

We have ascertained that, in the case of hard-temper copper wire, about 60% of the energy of the infrared radiation employed to heat the device is absorbed by the copper when the radiation impinges on a surface and about 40% of the energy is reflected back. In the case of a device according to the invention having a connecting element formed from a wire of square cross-section, then depending on the geometrical design of the element, for example on the orientation of the wire and the degree of tapering of the element, most of the radiation that is directed radially inwardly onto the outer surface of the element is reflected twice by the external faces of the wire before it is scattered away from the element and that a proportion of the radiation is reflected only once before it is scattered away. However, if the cross-section of the wire is changed so that the angle between neighboring faces on adjacent windings is reduced below 90°, the proportion of radiation that is reflected only once is reduced (usually to zero) and a proportion of the radiation, that increases as the angle is reduced, is reflected three or even more times, thereby reducing yet further the radiative energy that is scattered away by the element. The angle between the adjacent faces of the grooves (whether formed by tapping or milling or formed between adjacent windings of wire) is preferably not more than 90°. In some cases it may be desirable for the angle to be on neighbouring windings is preferably less than 80°, e.g. less than 70° and especially in the range of 40° to 65°. As an example, in the case of an element in which the faces are at an angle of 60°, approximately 80% of the incident radiation is reflected three times and 20% is reflected twice, which leads to about 92% of the incident being absorbed.

Normally the wire will have a square or rhombic cross-section and is arranged so that parts of the wire forming the internal surface of the connecting element define a screw thread. The connecting element may then be screwed onto the conductors to be connected in order to form a temporary electrical connection, for example for testing purposes before the permanent connection is made.

In the broadest aspect of the invention the device includes a connecting element having a single tapering internal surface so that for example a stub splice can be formed between a bundle of conductors inserted into one end of the sleeve, the other end of the sleeve for example being closed. However, it is possible for devices according to the invention to include connecting elements having two end portions, one or both of which are formed as a tapering helical coil of wire, so that, for example an in-line splice may be formed between a pair of bundles of conductors. Connecting elements in which one end does not have a screw thread could be employed, in which the bundle of wires is simply pushed into the connecting element. Where the connecting element is provided with a screw thread at each end, the screw threads may both have the same handedness, or one may be right-handed while the other is left-handed. Since it is not normally necessary to twist the sleeve about the conductors by more than one quarter to one half a revolution in order to form a temporary connection the choice of thread sense does not cause any particular problem. It is, however, possible for the end portions of the connecting element to be rotatable with respect to each other. For example, end portions formed from a wire may both be supported on a small cylindrical connecting element by wrapping part of the wire into a circumferential groove in the connecting element.

Where the end portions of the connecting element are rotatable with respect to each other it is often desirable to form the sleeve in two parts, each part being located on one of the end portions of the connecting element so that the connecting element end portions can be rotated by twisting the part of the sleeve it is located in.

Usually the sleeve will be dimensionally recoverable, and especially dimensionally heat-recoverable, that is to say the article has a dimensional configuration that may be made substantially to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, e.g. with alpha olefins such as 1-butene or 1-hexene, or vinyl acetate, polyamides or fluoropolymers, e.g. polytetrafluoroethylene, vinylidine fluoride or ethylenetetrafluoroethylene copolymer.

The fact that the ends of the conductors are enclosed in the connection element will also reduce the risk of any strands of the conductors piercing the sleeve during recovery thereof. Also, the conducting element can act as a heat-sink thereby preventing overheating of the device during recovery.

As mentioned above, the device includes a quantity of solder, i.e. a quantity of soft solder as distinct from brazing material, for forming a permanent solder connection. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, e.g. $Sn_{96.5}Ag_{3.5}$ eutectic will provide a visual indication that the device has been heated sufficiently to melt the lower melting point composition and to form a satisfactory solder joint. If desired the lower melting point solder may be a non-eutectic composition and, for example as described in International Application No. WO90/09255, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the stranded conductors, which can be caused by prolonged heating of the device.

The solder may be positioned anywhere where it will be able to flow into the connecting element to form a solder joint. The solder may be employed in the form of a ring or in any other form for example a ball, and may be disposed symmetrically about the sleeve axis or offset from it. The solder element may, for instance, be located at the smaller diameter end of the connecting element in which case it may be in the form of a ball or plug, or it may be located in the region of a large diameter end of the connecting element, for example in the form of a ring. Locating the solder axially adjacent to the connecting element has the advantage that the absorption of the infrared radiation will occur along the entire length of the connecting element but it has the disadvantage that the thermal contact between the solder and connecting element is reduced. In view of this it may be preferably to position the solder around the external surface of the connecting element in the form of a ring. This has the advantage that the thermal contact between the solder and the connecting element is improved (the solder being able to flow through the windings of the connecting element once it has fused). However the flat outwardly oriented surface of the solder will cause the infrared radiation to be reflected only once in the region where the solder ring masks the connecting element. For this reason it is preferred to employ a solder ring that is relatively thick (in the radial direction) and has a relatively small axial dimension in order to limit the degree of masking of the connecting element by the solder while maintaining a high degree of thermal contact between the two. Thus, for example, the solder ring preferably has an axial length that is not more than three times, and especially in the range of from one or two times its radial thickness. More than one quantity of solder may be employed, for example where the connecting element has more than one tapering internal surface for forming a splice.

One form of device and a method of installing it will now be described by way of example with reference to the accompanying drawings in which:

FIG. 1 is a sectional elevation of the device;

FIGS. 2 and 3 are side and end views of the device when located in an infrared heater;

Figure 4:
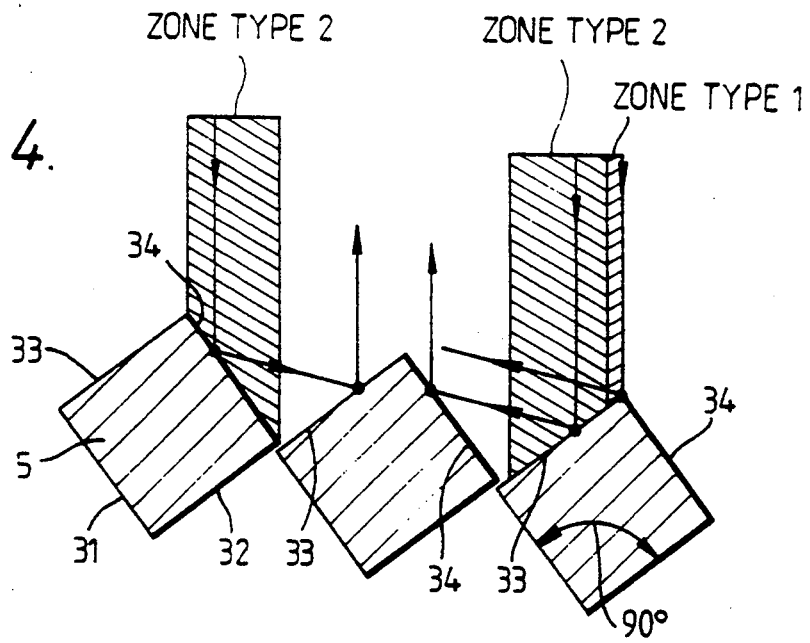
FIG. 4 shows the geometric path of radiation impinging on the connecting element the device formed from a wire with a square cross-section.
Figure 5:
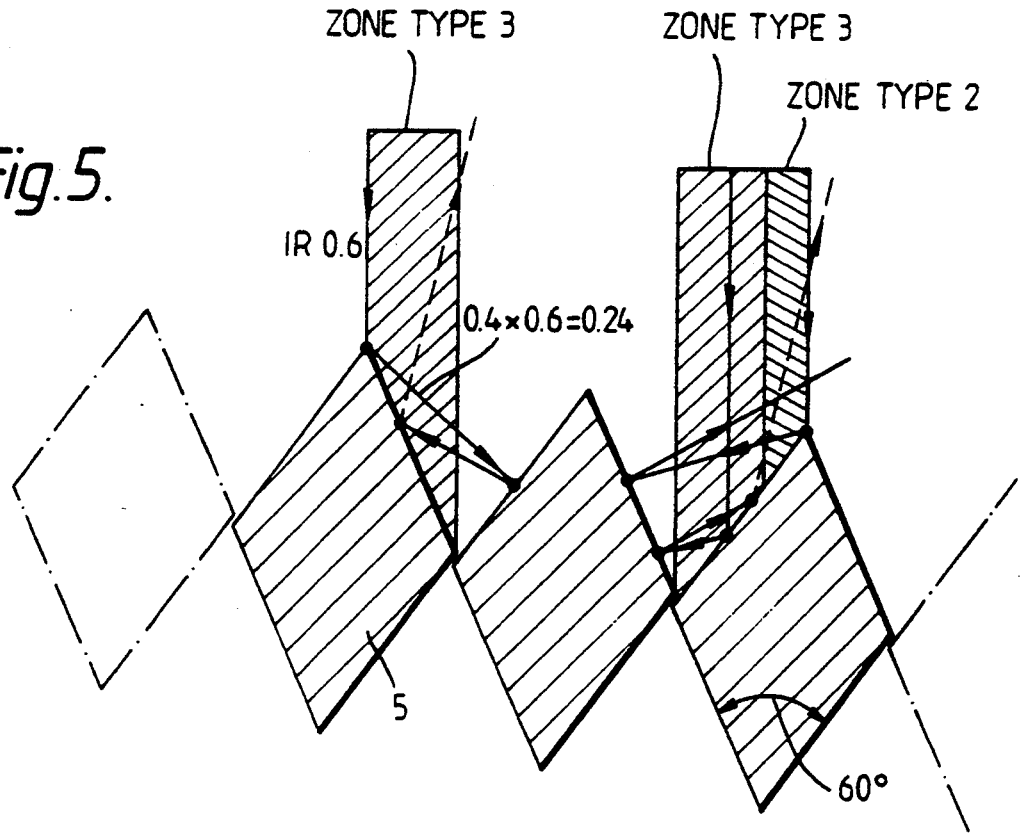
FIG. 5 shows the geometric path of radiation impinging on the connecting element of a device formed with a rhombic cross-section.
Figure 6:
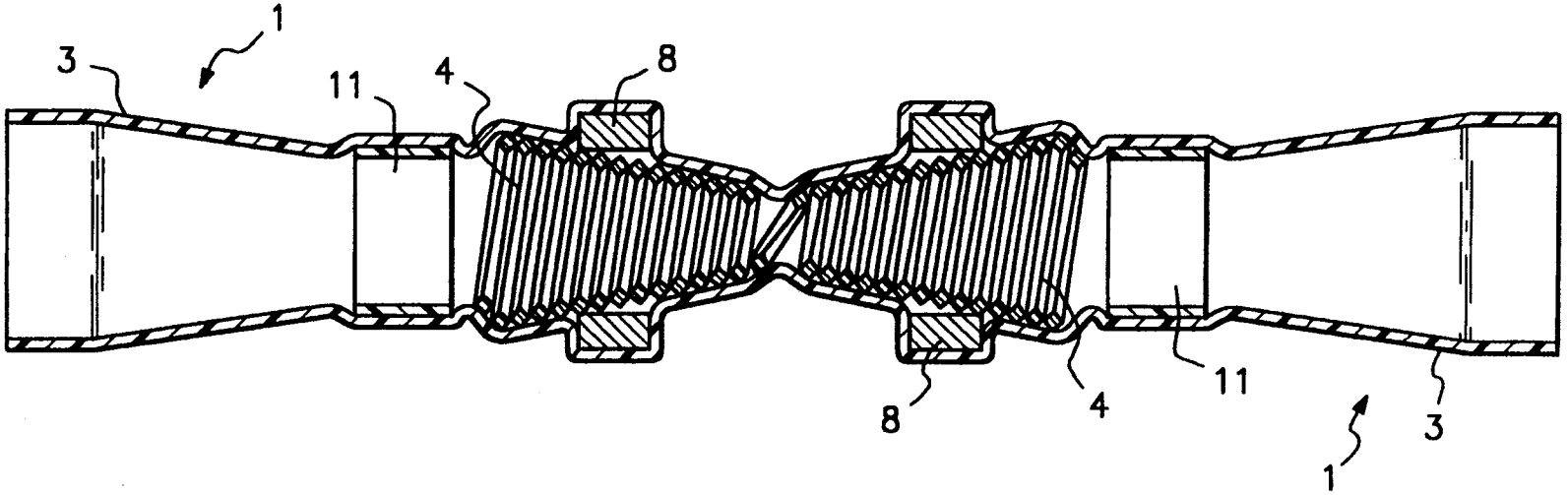
FIG. 6 is a sectional elevation along the axis of a second form of the device in which the connecting element has two end portions, both being formed as a tapering helical coil of wire.

Referring to the accompanying drawings, a device 1 for forming an electrical connection between a number of electrically insulated wires comprises a dimensionally heat-recoverable sleeve 3 formed from crosslinked and expanded polyvinylidine fluoride, and a connecting element 4 formed as a frusto-conical spring or coil of hard temper wire. The copper wire can have a cross-section in the form of a square as shown in FIG. 4 or a rhombus as shown in FIG. 5 in which sides, forming faces on the wire, are arranged at an angle of approximately 60° to on adjacent side and at an angle of approximately 120° to the other adjacent side. As shown in FIG. 5, the wire is coiled up so that the ridges formed by the faces that are at 60° to each other are located on the interior and the exterior of the element, the interior ridge forming a screw thread for holding the wires to be connected. One end of the wire located at the smaller diameter end of the connecting element 4 is bent so that it extends across the axis of the coil and prevents over insertion of the conductors to be connected. In some instances it may be advantageous to expand the diameter of the coil 4 by opening out the ends of the copper wire 5 and retaining them in their new position.

A ring 8 of $Sn_{63}Pb_{37}$ eutectic solder is located about the external surface of the connecting element 4 between the connecting element and the heat-shrinkable sleeve 3. The solder ring is relatively thick and short, its axial length being only approximately twice its radial thickness, so that as much of the connecting element as possible remains exposed.

One end of the sleeve in the region of the smaller diameter end of the connecting element is pre-recovered onto a spherical sealing element 10 formed from a fusible polymeric material, e.g. polyethylene, and a further sealing element 11 in the form of a ring is located within the sleeve adjacent to the other end of the connecting element 4.

In order to form an electrical connection between the wires in a bundle, their ends are stripped and inserted into the open end of the device 1 until they abut the end of the end of the wire 5 that has been bent across the axis of the coil and acts as a stop. The wires and device are then positioned axially in an infrared heater as shown schematically in FIGS. 2 and 3.

The infrared heater in essence comprises a quartz tube 20 around which is coiled a resistance heating element 21 and a ceramic spacer 22. The heating element 21 leads to terminal portions 23, and the element is surrounded by an insulating plaque. When the device 1 is inserted into the tube 20 and the heater is switched on, infrared radiation from the heating element will be directed radially inwardly onto the derive to cause the solder 8 to fuse and flow into the connecting element though the windings and to cause the recoverable sleeve 3 to shrink about the wires.

FIGS. 4 and 5 are sections through some of the windings of the connecting element. FIG. 4 shows windings of a device according to the invention formed from a square cross-section wire, while FIG. 5 shows windings of the device with a rhombic cross-section wire. The copper wire forming the connecting element has been flattened into four faces 31, 32, 33 and 34, and is oriented so that a ridge formed between adjacent faces 31 and 32 provides an internal screw thread of the connecting element. The wire windings are slightly offset vertically due to the taper of the connecting element (about 10°) and slightly twisted. As can be seen from FIG. 4, most of the infrared radiation that is incident on the external surface of the connecting element will be reflected from one external face, e.g. face 34, onto the adjacent face 33 of the neighbouring winding, whereupon it is reflected back, radially outwards. Areas of the connecting element in which this occurs are shown as "zone type 2". In addition, there is a small region referred to as "zone type 1" in which radiation is reflected only once by the element. In this configuration 93.7% of the surface is type 2 and 6.3% is type 1. If 60% of the power of incident radiation is absorbed and 40% reflected the overall percentage of incident radiation power that is absorbed can be calculated simply to be 82.5%. In the device as shown in FIG. 5 in which the angle between the faces of the wire 5 has been reduced from 90° to 60°, all the incident radiation is reflected twice while 80% is reflected three times (shown as "zone type 3"). Such a configuration can be shown by the same calculation to give a value of 91.7% for the overall percentage of incident power absorbed.

EXAMPLE

The rate at which test elements were heated was determined by forming machined frusto conical elements with different external surfaces but with identical masses. One of the elements had a flat tapering external surface, a second had an external surface that was machined into a series of V-shaped grooves in which the faces in each of the grooves were at a 90° angle to each other, and a third element was machined in the same way as the second element but with a 50° angle between the groove faces. A rigid thermocouple was mounted within the elements and they were placed inside an oven. The temperature that the elements had reached after one minute heating was recorded. The results are shown in the table, from which it can be seen that the element having a small angle (50°) between the ridge faces heated significantly more rapidly than the others.

TABLE

| ELEMENT | Temperature after 1 Minute/°C. |
|---|---|
| Smooth surface | 100 |
| 90° ridges | 130 |
| 50° ridges | 170 |

I claim:

1. A device for forming an electrical connection between a plurality of electrical conductors, which comprises an electrically insulating sleeve wherein the sleeve is dimensionally heat-recoverable, a metallic connecting element and a quantity of solder for forming a permanent electrical connection between the conductors, wherein the connecting element is located within the sleeve and has an external surface that is sufficiently uneven that a significant proportion of any radiation that is radially inwardly directed onto the external surface of the element will be reflected at least twice by the external surface of the element.

2. A device as claimed in claim 1, wherein the external surface of the connecting element is sufficiently uneven that at least 50% of any inwardly directed radiation is reflected at least twice by the external surface.

3. A device as claimed in claim 1, wherein the external surface has one or more grooves in which adjacent faces are separated by an angle of not more than 90°.

4. A device as claimed in claim 3, wherein the said angle is less than 70°.

5. A device as claimed in claim 4, wherein the angle is in the range of from 40° to 65°.

6. A device as claimed in claim 1, wherein the connecting element is formed from a tapering helical coil of wire.

7. A device as claimed in claim 6, wherein the wire has a square or rhombic cross-section and is arranged so that the parts of the wire forming the internal surface of the connecting element define a screw thread.

8. A device as claimed in claim 1, wherein the connecting element has two end portions one or both being formed as a tapering helical coil of wire.

9. A device as claimed in claim 2, wherein the external surface of the connecting element is sufficiently uneven that at least 70% of any inwardly directed radiation is reflected at least twice by the external surface.

10. A device as claimed in claim 2, wherein the external surface of the connection element is sufficiently uneven that at least 90% of any inwardly directed radiation is reflected at least twice by the external surface.

11. A method of forming an electrical connection between a plurality of electrical conductors, which comprises:

(i) positioning about the conductors a device which comprises an electrically insulating sleeve, a metallic connecting element and a quantity of solder, wherein the connecting element is located within the sleeve and has a tapering internal surface with a screw thread, and has an uneven external surface;

(ii) twisting the device about the conductors to hold them in the connection element; and (iii) applying infrared radiation radially inwardly to heat the device and so cause the solder to melt and form a permanent connection between the conductors;

wherein a significant proportion of the radiation is reflected at least twice by the external surface of the connecting element.

* * * * *